United States Patent [19]

Simington

[11] Patent Number: 4,702,200

[45] Date of Patent: Oct. 27, 1987

[54] LIVESTOCK HEAD HOLDER

[75] Inventor: Jack F. Simington, Chiloquin, Oreg.

[73] Assignee: Simington Products Company, Chiloquin, Oreg.

[21] Appl. No.: 852,647

[22] Filed: Apr. 16, 1986

[51] Int. Cl.[4] ..... A61D 3/00

[52] U.S. Cl. ..... 119/99; 119/103

[58] Field of Search ..... 119/99, 103

[56] References Cited

U.S. PATENT DOCUMENTS

| | | | |
|---|---|---|---|
| 192,939 | 7/1877 | Rutledge | 119/99 |
| 2,113,741 | 4/1938 | Peterson | 119/99 |
| 3,892,203 | 7/1975 | Tieben | 119/99 |
| 4,544,501 | 10/1985 | Anderson et al. | 119/99 |

*Primary Examiner*—Carl D. Friedman

*Assistant Examiner*—Caroline D. Dennison

*Attorney, Agent, or Firm*—Kolisch, Hartwell & Dickinson

[57] ABSTRACT

The head holder of the instant invention is intended for use on a cattle chute, the chute having a vertically elongate opening at one end thereof allowing passage of the head only of animal restrained in the chute therethrough. The head holder includes a head catch for engaging the head of an animal adjacent to the animal's neck and positioning means for positioning the head catch. The positioning means includes a pivotable mount allowing selective positioning of the catch between a head engaging position and a disengaged position and elevating means for selectively raising and lowering the head catch.

2 Claims, 4 Drawing Figures

LIVESTOCK HEAD HOLDER

BACKGROUND AND SUMMARY OF THE INVENTION

The instant invention relates to a head holder for livestock and particularly to a head holder which provides easy access to the animal's head for examination and treatment thereof.

A variety of head holders are known. Most of the known devices immobilize an animal's head and in the process obscure the eyes and ears of the animal and make it very difficult to open the animal's mouth. Known head holders generally involve the application of a sling underneath the animal's head or involve the fastening of the animal's head to a stationary platform, again, by securing the animal's head to a chin or throat rest.

An object of the instant invention is to provide a head holder for an animal which substantially immobilizes the animals head while allowing access to the orifices and organs carried on the animal's head.

Another object of the instant invention is to provide a head holder which may be easily mounted on and removed from a livestock chute door.

A further object of the instant invention is to provide a livestock head holder which swings free of the opening between the doors of a livestock chute when the doors are open, thereby allowing the animal unimpeded egress from the chute.

Another object of the instant invention is to provide a livestock head holder which substantially immobilizes the animal's head without causing appreciable discomfort or harm to the animal.

Still another object of the instant invention is to provide a livestock head holder which is inexpensive to manufacture, and is easy and simple to operate and maintain.

The head holder of the instant invention is intended for use on a cattle chute, the chute having a vertically elongate opening at one end thereof allowing passage of the head only of animal restrained in the chute therethrough. The head holder includes a head catch for engaging the head of an animal adjacent to the animal's neck and positioning means for positioning the head catch. The positioning means includes a pivotable mount allowing selective positioning of the catch between a head engaging position and a disengaged position and elevating means for selectively raising and lowering the head catch.

These and other objects and advantages of the instant invention will become more fully apparent as the description which follows is read in conjunction with the drawings.

DETAILED DESCRIPTION OF A PREFERRED EMBODIMENT

Figure 1:
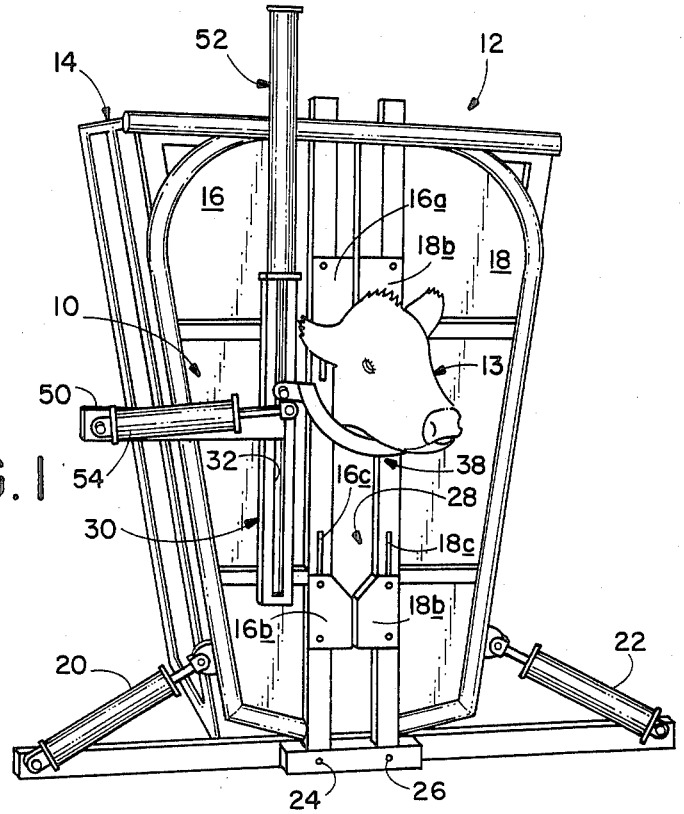
FIG. 1 is a perspective view of a cattle chute having a head holder constructed according to the invention mounted thereon.

Turning initially to FIG. 1, a livestock head holder constructed according to the invention is showing generally at 10. Head holder 10 is mounted on a cattle chute 12 having an animal 13 restrained therein.

Chute 12 includes a cage like framework 14 and a pair of opposed, laterally shiftable doors 16, 18. Doors 16 and 18 are operated by cylinders 20, 22, respectively. Contraction of cylinders 20, 22 cause doors 16 and 18 to pivot about pivot points 24, 26, respectively, thereby shifting the doors to their open positions. Extension of cylinders 20 and 22 cause doors 16 and 18 to shift to their closed positions.

Doors 16 and 18 are constructed and arranged such that a vertical, elongate opening 28 is present between the doors when the doors are in their closed positions. The upward limit of opening 28 is defined by dogs 16*a*, 18*a* which are carried on doors 16 and 18, respectively. The downward limit of opening 28 is defined by another pair of dogs 16*b*, 18*b*. The dogs are adjustable in slots, such as slots 16*c*, 18*c* to allow variation in the vertical size of opening 28.

Figure 2:
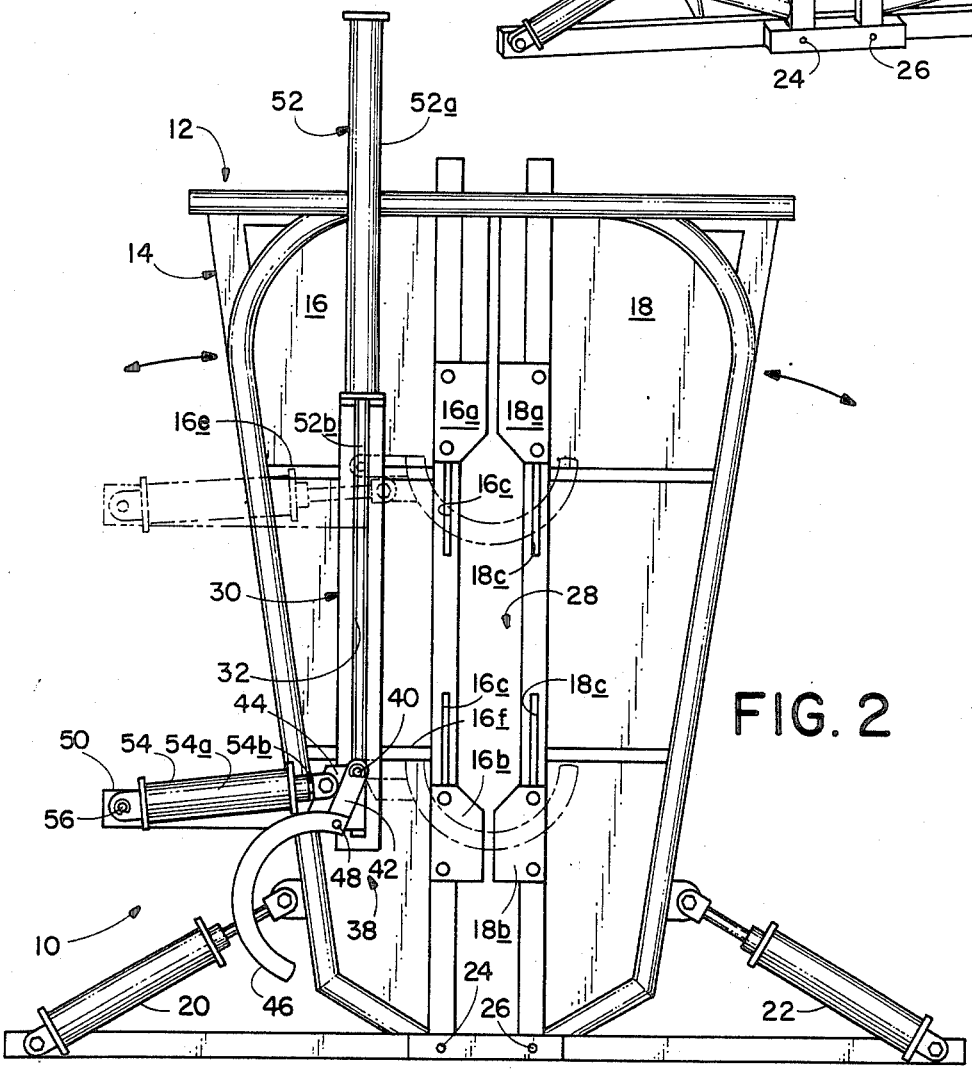
FIG. 2 is a front view of a cattle chute, with the head holder of the invention mounted thereon shown in a disengaged condition.
Figure 3:
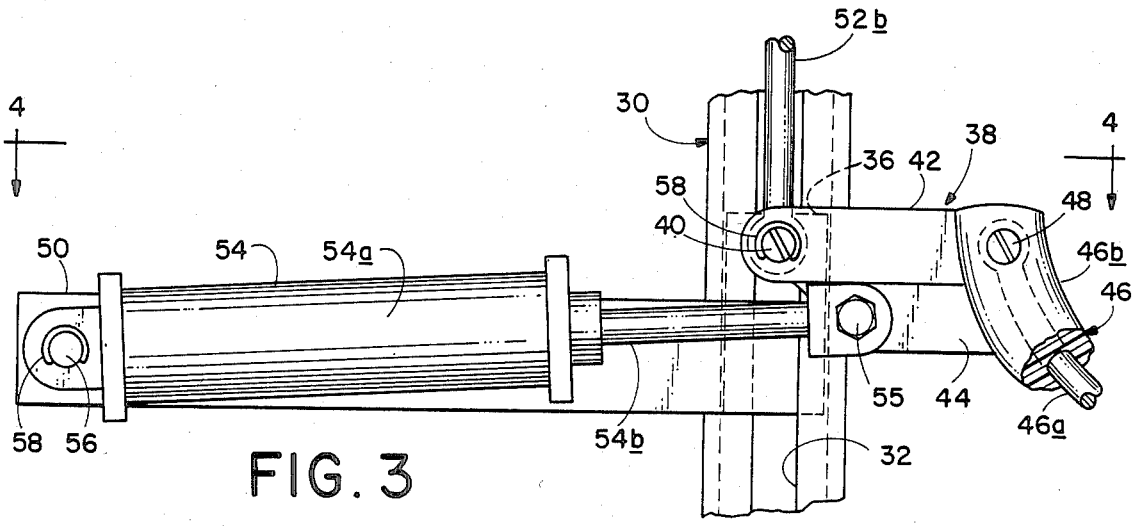
FIG. 3 is a partial enlarged front view of positioning means of the invention.
Figure 4:
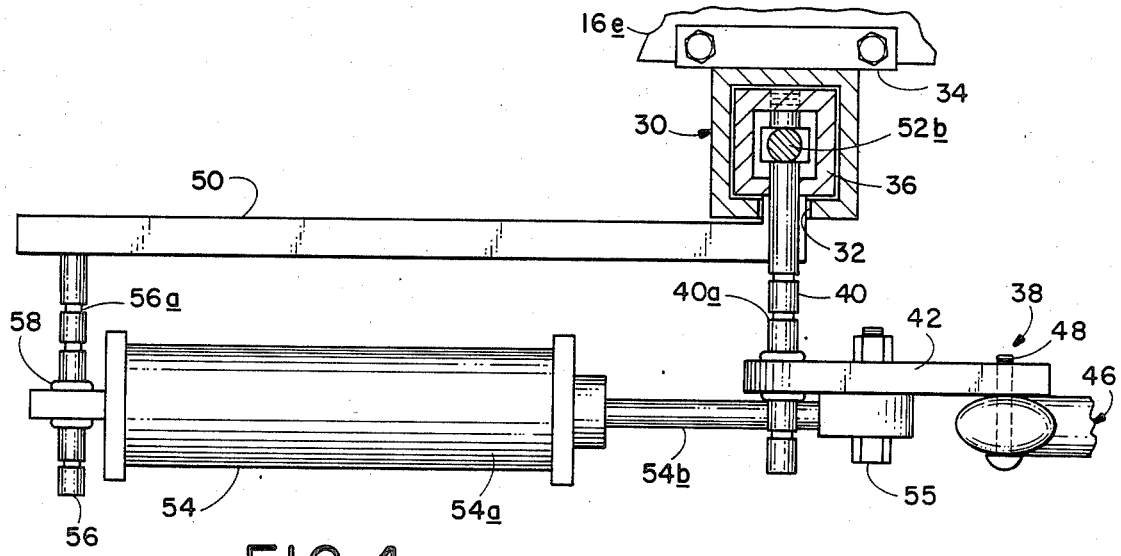
FIG. 4 is a sectional top plan view of positioning means, taken generally along 4—4 of FIG. 3.

Referring now to FIGS. 2–4, head holder 10 will be described in greater detailed. Holder 10 includes an elongate guide 30. Guide 30, in the preferred embodiment, is a hollow tubular structure and includes a slot 32 in the forward face thereof. Guide 30 is mounted on one door only, such as door 16, of the chute and is held in place by flanges, such as flange 34 (FIG. 4) which is bolted to cross members 16*e*, 16*f* of door 16. Guide 30 therefore extends along one side only of elongate opening 28.

A mounting element 36 is, in the preferred embodiment, slidably carried within guide 30 and provides a pivotable mount for a head catch 38. In the preferred embodiment, the pivotable mount includes a pivot pin 40 which extends through slot 32 and which is fixed to the rear side of mounting element 36, as by, for instance, the provision of a tapped bore for receiving a threaded end of pin 40. Head catch 38 is pivotably mounted on pivot pin 40 and includes, in the preferred embodiment, a pivot arm 42, a cylinder attaching plate 44 and a substantially U-shaped rod 46.

Referring now to FIG. 3, rod 46 includes a metal core 46*a* and a wrapping 46*b* which covers rod 46*a* to provide a more gentle contact between the head holder and the animal. In the preferred embodiment, rod 46 is secured to arm 42 by fastener 48 and plate 44 is fixed to arm 42 as by welding.

Mounting element 36 has a bracket 50 affixed to the front face thereof. Bracket 50 extends through slot 32 and then extends laterally away from opening 28.

In the preferred embodiment, powered means are provided for moving element 36 along guide 30 and for positioning head catch 38. Powered means includes, referring now to FIGS. 1 and 2, a first hydraulic ram 52 (first powered means) which is mounted at the upper end of guide 30. Ram 52 includes the usual cylinder 52*a* and a rod 52*b* which extends from one end of the cylinder. (For purposes of clarity, conventional hydraulic supply lines have been omitted from the drawings.) The free end of rod 52*b* is attached to element 36 and is secured to element 36 by means of pivot pin 40, which extends through a clevis on the end of the rod. With the operation of ram 52, element 36 is shifted along guide 30.

A second ram 54 (second powered means) includes a cylinder 54*a* and a rod 54*b*. One end of cylinder 54*a* is secured to the free end of bracket 50 by pin 56 while the free end of rod 54*b* is attached to plate 44 by nut and bolt combination 55. Ram 54 is operable for selectively, pivotably positioning head catch 38 between a disengaged position, as shown by solid lines in FIG. 2, where the head catch is withdrawn to a side of opening 28 and a head engaging position, is shown by dash-dot lines in FIG. 2, where the head catch extends across opening 28. Conventional manually operated hydraulic controls are provided for rams 20, 22, 52 and 54 in the preferred embodiment.

With the catch in a head engaging position, first ram 52, also referred to herein as elevating means, is operable to selectively raise and lower the head catch in front of opening 28, to an upper position, as shown by dash-double-dot lines in FIG. 2.

Referring now to FIG. 4, head catch 38 is shiftable along pivot pin 40 for adjusting the distance between the head catch and elongate opening 28. This is accomplished by the provision of grooves 40*a*, 56*a* in pivot pin 40 and mounting pin 56, respectively. Split rings, such as ring 58, are provided and cooperate with grooves 40*a* and 56*a* to fix ram 54 and head catch 38 in a desired position relative to opening 28. This feature enables the head catch to accommodate animals having various length necks and also provide a versatile head holder which can be adjusted to contact various parts of the animal's head.

Operation

Beginning with the configuration shown in solid lines in FIG. 2, an animal is introduced into chute 12. The animal's head is drawn through opening 28 and the operator extends ram 54, thereby shifting head catch 38 from its disengaged position to its engaged position, as shown by the dash-dot lines in FIG. 2. Ram 52 is activated, thereby drawing rod 52*b* into the cylinder, and raising head catch 38 along with ram 54 upwards. Rams 52 and 54 are connected to a hydraulic fluid supply (not shown) and are restricted to relatively slow operation, to avoid injuring an animal restrained in the chute. The head catch is raised until the back of the animal's head or neck contacts dogs 16*a*, 18*a*. Needless to say, care must be exercised to prevent raising of the head catch to the point where it causes strangulation of the animal.

With the catch in the position shown in dash-double-dot lines in FIG. 2, and as depicted in FIG. 1, it is possible to treat the animal's ears, eyes, nose, as well as the organs found in the animal's mouth. Additionally, horns may be treated or removed while the animal is restrained in the chute and its head held steady by the head holder of the invention.

Upon completion of the treatment, ram 52 may be extended, ram 54 contracted, returning the head catch to the position shown in solid lines in FIG. 2. Cylinders 20, 22 may be contracted, thereby swinging door 16 and 18 outward, as shown by the double headed arrows in FIG. 2, allowing the animal to freely egress the chute without being impeded by the head catch. Doors 16 and 18 may then be closed, and the operation repeated as often as necessary.

Thus a livestock head holder has been disclosed which substantially immobilizes an animal's head and which allows free access to the animal's head for treatment or examination. The head holder may be easily mounted and removed from a cattle chute. The head catch of the invention swings free of an opening in the cattle chute to allow an animal retained in the chute unimpeded egress from the chute.

Although a preferred embodiment of the invention has been disclosed, it should be appreciated that variations and modifications may be made thereto without departing from the spirit of the invention.

It is claimed and desired to secure by Letters Patent:

1. A livestock head holder for use on a cattle chute, the chute having a pair of opposed, laterally shiftable doors at an end thereof and a vertical, elongate opening between the doors for allowing, with the doors in a closed position, passage of the head only of an animal restrained in the chute through the opening, the holder comprising:

a head catch for engaging the head of an animal restrained in the chute;

an elongate, tubular guide having a slot in the forward side thereof, mounted on one of the doors of the chute; and a mounting element slidably received in said guide, a pivot pin carried on said element, said pin projecting through said slot and carrying said head catch pivotably thereon, wherein said head catch is shiftable along said pivot pin for adjusting horizontally the distance between said head catch and the elongate opening of the chute, said element being shiftable along said guide; and, powered means for shifting said element along said guide, and a bracket carried on said element, said bracket extending through said slot, and another powered means mounted on said bracket for pivoting said head catch.

2. In combination with a cattle chute having a pair of opposed, laterally shiftable doors at an end thereof and a vertical, elongate opening between the doors for allowing, with the doors in a closed position, passage of the head only of an animal restrained in the chute, a head holder comprising:

a substantially U-shaped head catch for engaging the animal's head adjacent the neck of the animal;

a catch carrying element for pivotably carrying said head catch, said head catch being pivotable between a head engaging position wherein the catch extends across the opening and a disengaged position wherein the catch is withdrawn to a side of the opening;

an elongate, tubular mounting for said carrying element, said mounting being fixed to one of the shiftable doors and extending along and adjacent to the opening, said mounting having a slot extending intermediate its end in a forward face thereof, said carrying element being movable along the length of said mounting, and including a pin carried thereon which projects through said slot longitudinally away from said chute for carrying said head catch wherein said head catch is horizontally shiftable along said pin for adjusting the longitudinal, horizontal distance between said head catch and the elongate opening of the chute, said element further including a bracket carried thereon which also projects through said slot, said bracket extending laterally away from said opening;

first powered means for moving said element along said mounting; and second powered means for pivoting said head catch between the aforementioned positions located on the distal end of said bracket.

* * * * *